US006543328B1

(12) United States Patent
Plummer et al.

(10) Patent No.: US 6,543,328 B1
(45) Date of Patent: Apr. 8, 2003

(54) CONVERTIBLE MULTIPURPOSE MISSILE LAUNCHER

(75) Inventors: Brady A. Plummer, Fishers, IN (US); Robert A. Bailey, Avon, IN (US); Carl P. Nicodemus, Indianapolis, IN (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/960,814

(22) Filed: Sep. 21, 2001

(51) Int. Cl.[7] ..... F41F 7/00
(52) U.S. Cl. ..... 89/1.54; 89/1.819
(58) Field of Search ..... 89/1.814–1.819, 89/1.54, 1.59

(56) References Cited

U.S. PATENT DOCUMENTS 3,983,785 A * 10/1976 Dissmeyer
4,423,661 A * 1/1984 Sheldon
4,660,456 A * 4/1987 Griffin
4,736,669 A * 4/1988 Long
4,745,840 A * 5/1988 Long
4,750,404 A * 6/1988 Dale
4,829,876 A * 5/1989 Witt
4,870,885 A * 10/1989 Grosselin
4,911,059 A * 3/1990 Bruckner
4,926,740 A * 5/1990 Griffin

FOREIGN PATENT DOCUMENTS

JP 05031937 * 9/1994

* cited by examiner

*Primary Examiner*—Michael J. Carone
*Assistant Examiner*—Troy Chambers
(74) *Attorney, Agent, or Firm*—William C. Schubert; Glenn H. Lenzen, Jr.

(57) ABSTRACT

A convertible multipurpose missile launcher includes a launch rail structure on the launcher body with a first-missile launch rail on the bottom side of the launcher body extending in a longitudinal direction. The first-missile launch rail is dimensioned for a first missile. A second-missile launch rail is positioned on the bottom side of the launcher body and extends in the longitudinal direction. The second-missile launch rail is dimensioned for a second missile different from the first missile. The second-missile launch rail includes a stationary second-missile forward launch rail segment, and a movable second-missile aft launch rail segment. The movable second-missile aft launch rail segment is slidable on the launcher body, and preferably on the first-missile launch rail, between a forward position and an aft position and may be locked in these positions.

20 Claims, 4 Drawing Sheets

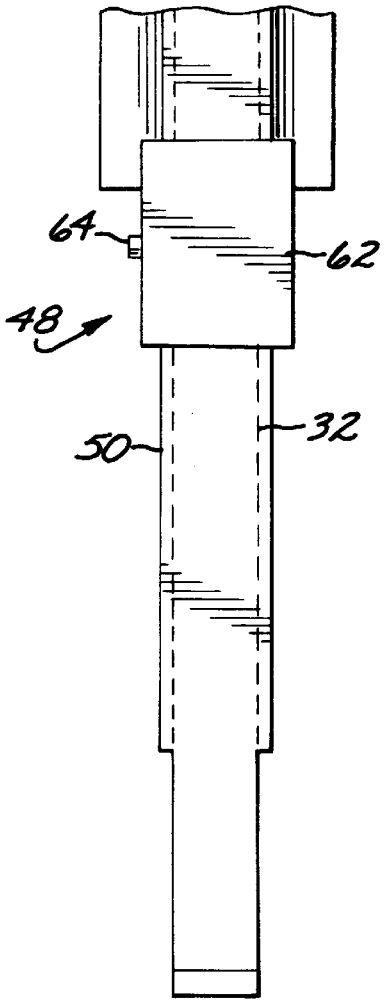
FIG. 6
FIG. 7
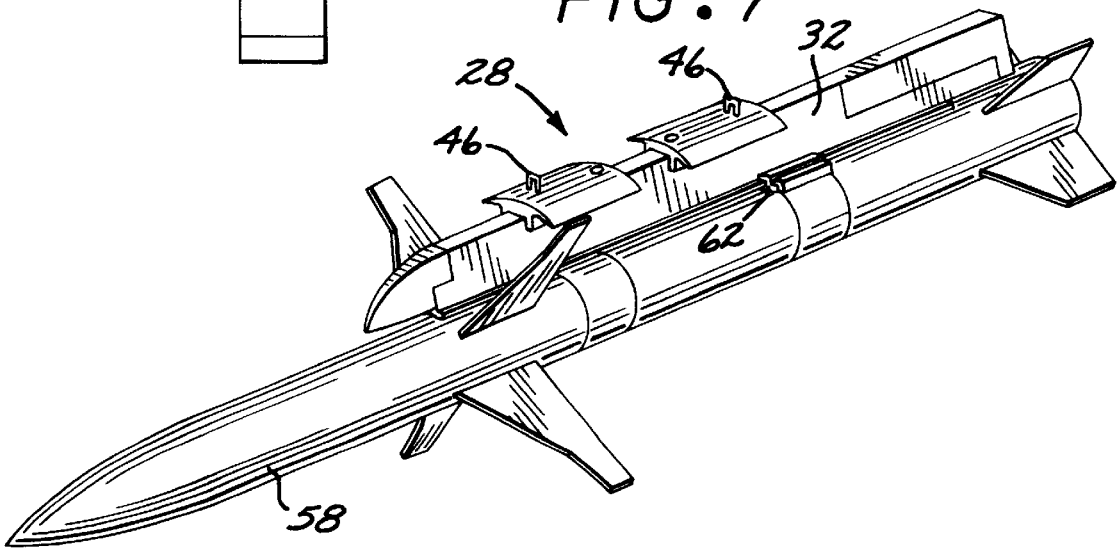

CONVERTIBLE MULTIPURPOSE MISSILE LAUNCHER

This invention relates to a missile launcher that launches a missile from an aircraft and, more particularly, to such a missile launcher that may be converted so as to launch different types of missiles.

BACKGROUND OF THE INVENTION

Many types of fixed-wing and helicopter military aircraft carry missiles externally on missile launchers. The missile launchers are supported from hard points on the wings and/or fuselage of the aircraft, and the missiles are carried on support locations on the missile launchers. In the most common approach, the missile has a set of rails on its surface that interlock with corresponding rails on the missile launcher. When the missile is fired, the missile slides forward on the rails until it leaves the rails and drops free of the aircraft.

Because of the many types of missiles that may be carried externally on different missions, there are a number of different launchers for supporting the missiles from the aircraft hard points. These launchers usually vary in the spacing and length of the rails, and their forward/aft positioning according to the center of gravity of the missile. When an aircraft is to be changed over to a different configuration of missiles for another mission, the prior launchers are removed, the new launchers are installed, and the new missiles are installed on the new launchers. This changeover process takes time and may lead to confusion and errors when conducted in a wartime environment. Additionally, there are a number of different launcher systems that must be provided and maintained to support each aircraft.

The present inventors have recognized that there is a need for an improved approach to the carrying of different types of missiles by aircraft, so that conversion between the use of different missiles is quicker and more convenient. Such an improved approach would require any changes to be in the missile launcher, because the missiles themselves are fixed in their configurations responsive to their missions. The present invention fulfills this need, and further provides related advantages.

SUMMARY OF THE INVENTION

The present invention provides a multipurpose missile launcher that stays on the aircraft, and is reconfigured by a simple conversion process for the carrying of different types of missiles. Thus, two or more different types of missiles may be carried on and launched from the same attachment location of the missile launcher, following reconfiguration. This capability allows the aircraft to be quickly converted between different types of missions, such as primarily air-to-air missions, or primarily air-to-ground anti-radar missions, or primarily air-to-ground general attack missions. Equally importantly, the number of different launcher systems required that must be provided and maintained is reduced over prior approaches. This reduced logistics and support requirement is highly significant, as it simplifies aircraft operations in a wartime environment.

In accordance with the invention, a convertible multipurpose missile launcher comprises a launcher body having a top side, a bottom side, a first lateral side, a second lateral side, a forward end, and an aft end. There is a support attachment on the top side of the launcher body used to attach the missile launcher to a portion of an aircraft, such as a bomb rack at a wing or fuselage hard point. A launch rail structure is also provided on the launcher body. The launch rail structure includes a first-missile launch rail on the bottom side of the launcher body, extending in a longitudinal direction between the forward end and the aft end of the launcher body. The first-missile launch rail is dimensioned for a first missile. A second-missile launch rail is provided on the bottom side of the launcher body, extending in the longitudinal direction between the forward end and the aft end of the launcher body. The second-missile launch rail is dimensioned for a type of second missile different from the type of the first missile. The second-missile launch rail includes a stationary second-missile forward launch rail segment, and a movable second-missile aft launch rail segment. The movable second-missile aft launch rail segment is preferably slidable on the launcher body, and most preferably on the first-missile launch rail itself, between a forward position and an aft position. The movable second-missile aft launch rail segment may be locked in the forward position when slid to the forward position and locked in the aft position when slid to the aft position. The movable second missile aft launch rail segment is preferably not removed from the missile launcher when the missile launcher is configured to carry the first missile, but instead is slid rearwardly out of the way of the first missile and locked in place.

In an embodiment of interest, the first missile is a Maverick missile, whose use requires the movable second-missile aft launch rail segment to be in the aft position. In this embodiment, the second missile is a HARM anti-radar missile, whose use requires the movable second-missile aft launch rail segment to be in the forward position.

To expand the ability of the missile launcher to carry and launch a third or a fourth type of missile, a third-missile launcher may optionally be provided on the first lateral side of the launcher body. The third-missile launcher preferably has a third-missile launch rail extending in the longitudinal direction between the forward end and the aft end of the launcher body. The third-missile launch rail is dimensioned for a third type of missile, such as a Sidewinder, AMRAAM, or ASRAAM missile, typically different from the first type of missile and the second type of missile. A fourth-missile launcher may be provided on the second lateral side of the launcher body. The fourth-missile launcher preferably has a fourth-missile launch rail extending in the longitudinal direction between the forward end and the aft end of the launcher body. The fourth-missile launch rail is dimensioned for a fourth type of missile, which may be the same as the third type of missile or of a different type. Preferably, the fourth missile launch is also a Sidewinder, AMRAAM, or ASRAAM missile.

Normally, the various types of missiles are not carried at the same time on the missile launcher. However, different types of missiles may be carried on the same missile launcher, where they are mechanically, electrically, and otherwise compatible.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 6 is a bottom view of the preferred missile launcher with the movable second-missile aft launch rail segment in the forward position;

FIG. 7 is a perspective view of a HARM missile carried on the first-missile launch rail with the movable second-missile launch rail segment in the forward position;

DETAILED DESCRIPTION OF THE INVENTION

Figure 1:
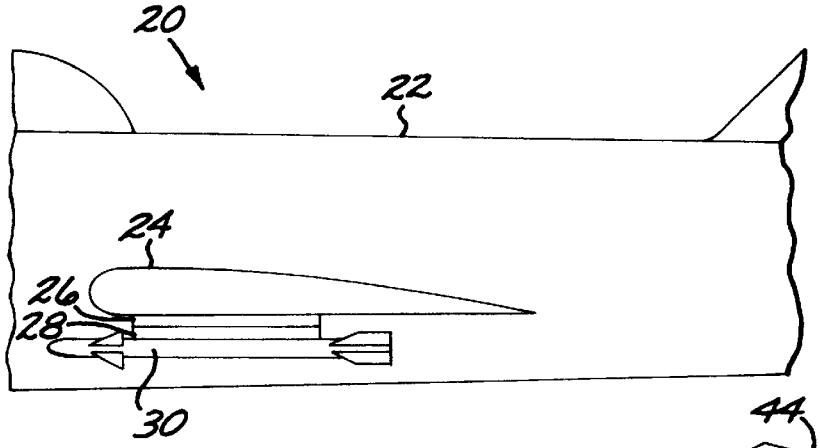
FIG. 1 is a schematic fragmented elevational view of an aircraft with a missile launcher affixed to its wing.

FIG. 1 depicts a portion of an aircraft 20 having a fuselage 22 and a wing 24 extending therefrom. Extending downwardly from the wing 24 is a bomb rack 26, a missile launcher 28 attached to the bomb rack 26, and a missile 30 supported from the missile launcher 28. The missile launcher 28 may instead be supported from the fuselage 22 or it may extend from a wingtip or other location on the aircraft.

The missile launcher 28, shown in greater detail in FIGS. 2–8, includes a launcher body 32 having a top side 34, a bottom side 36, a first lateral side 38, a second lateral side 40, a forward end 42, and an aft end 44. A support attachment 46 to attach the launcher body 32 to the bomb rack 26 is on the top side 34 of the launcher body 32. In the illustrated embodiment, the support attachment is a loop which mates to a hook (not shown) on the underside of the bomb rack 26.

A launch rail structure 48 is present on the launcher body 32. The launch rail structure 48 includes a first-missile launch rail 50 on the bottom side 36 of the launcher body 32 and extending in a longitudinal direction 52 extending at least a portion of the distance between the forward end 42 and the aft end 44 of the launcher body 32. The first-missile launch rail 50 is a stationary part of the launcher body 32. The first-missile launch rail 50 is dimensioned for the corresponding rails of a first missile 54, seen in FIG. 4. In the preferred embodiment, the first missile 54 is a Maverick missile, a known type of missile, and the first-missile launch rail 50 is compatible with the dimensions of an LAU-117 launcher used with the Maverick missile. To load the first missile 54 onto the first-missile launch rail 50, the first missile 54 is positioned in front of the missile launcher 28 and moved rearwardly, while engaging the rails on the top of the missile 54 with the first-missile launch rail 50.

Figure 8:
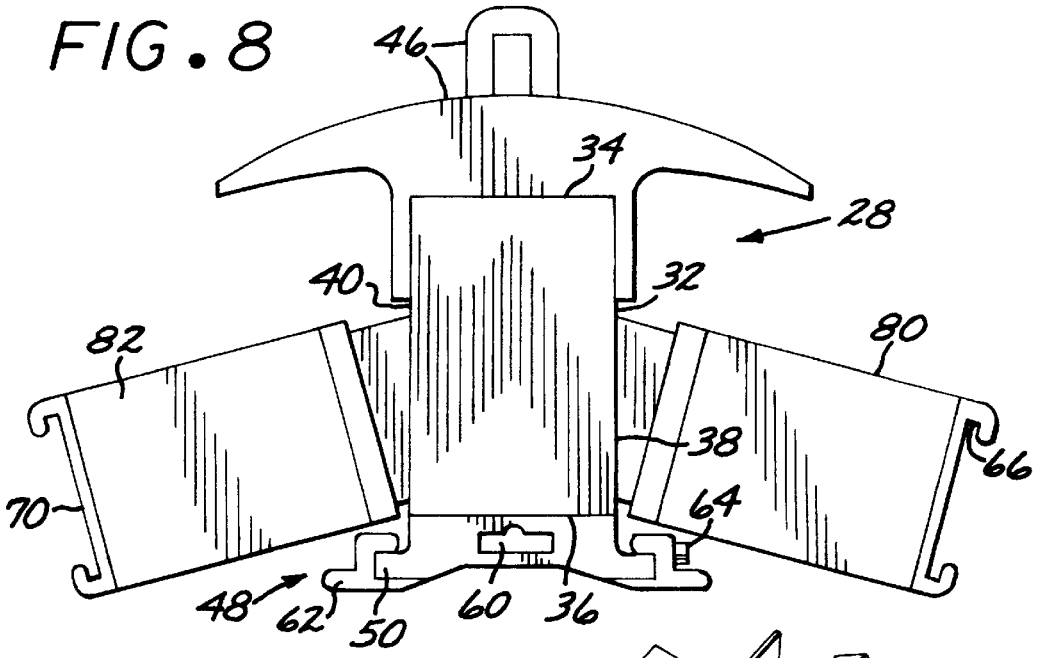
FIG. 8 is a front view of the preferred missile launcher.

A second-missile launch rail 56 is also on the bottom side 36 of the launcher body 32. The second-missile launch rail 56 extends in the longitudinal direction 52. The second-missile launch rail 56 is dimensioned for the corresponding rails of a second missile 58 different from the first missile 54. In the preferred embodiment, the second missile 58 is a HARM missile, a known type of missile shown in FIG. 7, and the second-missile launch rail 56 is compatible with the dimensions of an LAU-118 launcher (but not the LAU-117 launcher because of its different construction). The second-missile launch rail 56 includes a stationary second-missile forward launch rail segment 60 (FIG. 8), and a movable second-missile aft launch rail segment 62. In the case of the HARM missile and as illustrated in FIG. 8, the stationary second missile forward launch rail segment 60 has a width between the rails of about 1 inch, while the movable second-missile launch rail segment 62 has a width between the rails of about 5 inches and a length of about 8 inches. These dimensions are dictated by the corresponding rails of the missile itself. Because of the width of its back rail, the movable second-missile launch rail segment 62 would prevent the loading of a Maverick missile onto the first-missile launch rail if the movable second-missile launch rail segment 62 were left in the forward position required for the HARM missile.

Figure 2:
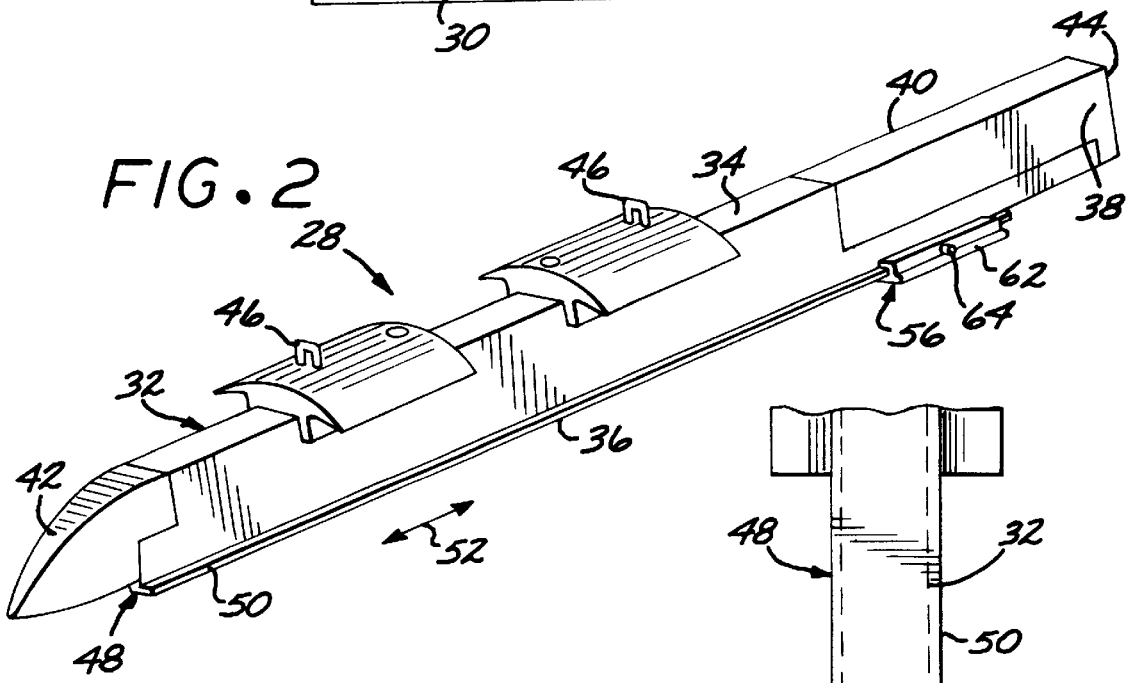
FIG. 2 is a perspective view of a preferred missile launcher with the movable second-missile aft launch rail segment in the aft position.
Figure 3:
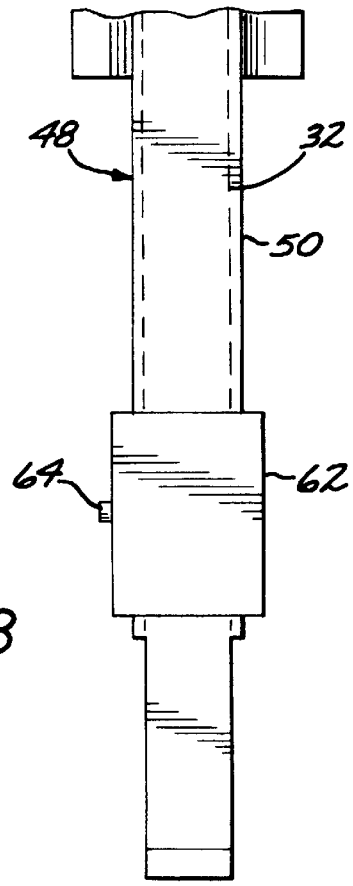
FIG. 3 is a bottom view of the preferred missile launcher with the movable second-missile aft launch rail segment in the aft position.
Figure 4:
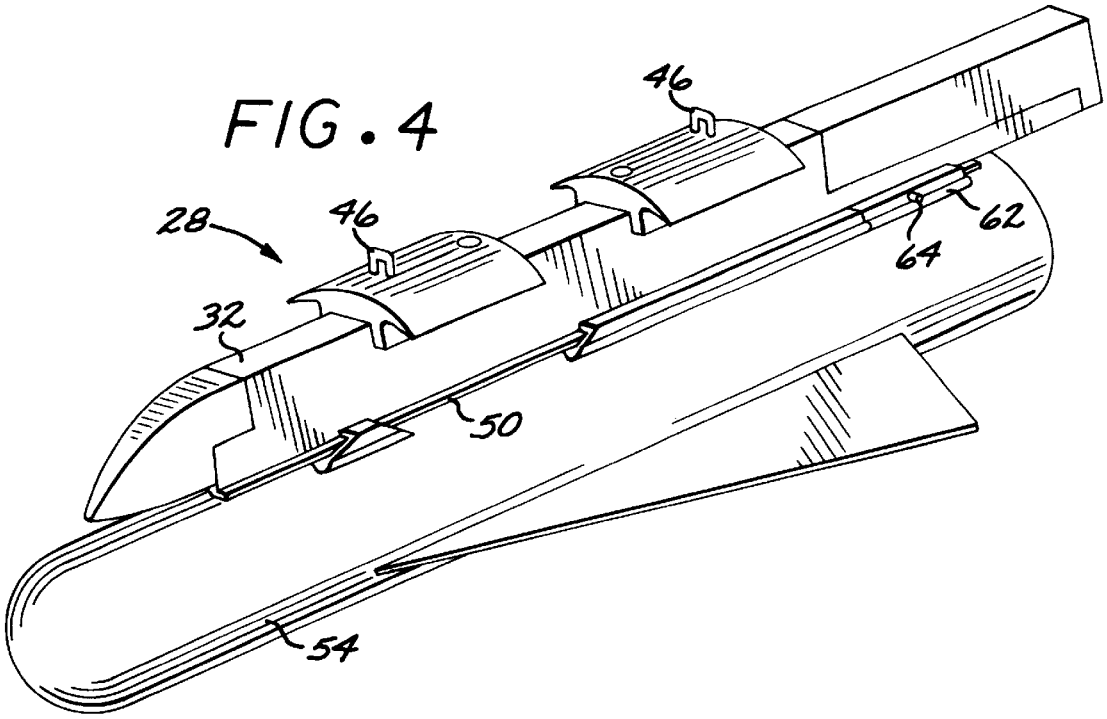
FIG. 4 is a perspective view of a Maverick missile carried on the first-missile launch rail with the movable second-missile aft launch rail segment in the aft position.
Figure 5:
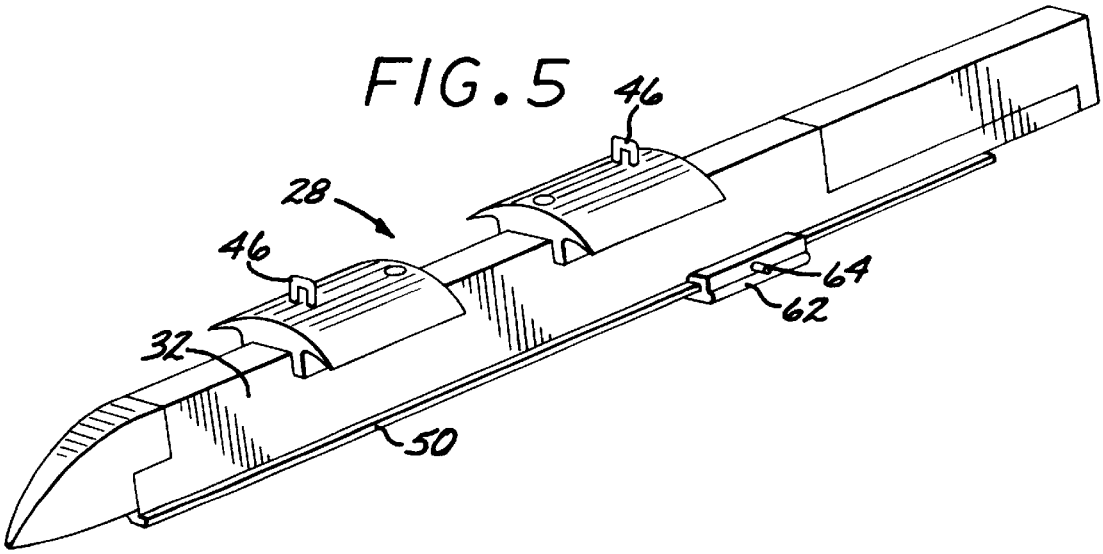
FIG. 5 is a perspective view of a preferred missile launcher with the movable second-missile aft launch rail segment in the forward position.

The movable second-missile aft launch rail segment 62 is therefore movable, and in the preferred embodiment slidable on the launcher body 32 between a forward position shown in FIG. 5–7 and an aft position shown in FIGS. 2–4. More preferably, the movable second-missile aft launch rail segment 62 is slidable on the first-missile launch rail 50, creating a rail-on-rail configuration. The movable second-missile aft launch rail segment 62 may be locked in the forward position by any approach, such as an indicated locking pin 64 extending through a transverse hole (not visible) in the launcher body 32, when slid to the forward position (FIG. 6) and locked in the aft position when slid to the aft position (FIG. 3) by the same or another approach.

Where the first missile 54 is to be loaded onto the missile launcher 28, the movable second-missile aft launch rail segment 62 is moved to its aft position (FIGS. 2–3) and locked in place. The first missile 54, illustrated as the Maverick missile of FIG. 4, is loaded onto the first-missile launch rail 50. The movable second-missile aft launch rail segment 62 serves as the rear stop for the movement of the first missile 54.

Where the second missile 58 is to be loaded onto the missile launcher 28, the movable second-missile aft launch rail segment 62 is moved to its forward position (FIGS. 5–6) and locked in place. The second missile 58, illustrated as the HARM missile of FIG. 7, is loaded onto the second-missile launch rail 56, which comprises the stationary second-missile forward launch rail segment 60 and the movable second-missile aft launch rail segment 62 (in its forward position). The first-missile launch rail 50 here serves only as the track upon which the second-missile aft launch rail segment 62 moves. The first missile 54 and the second missile 58 are not loaded and carried at the same time on the aircraft, but instead are used on different missions.

Figure 9:
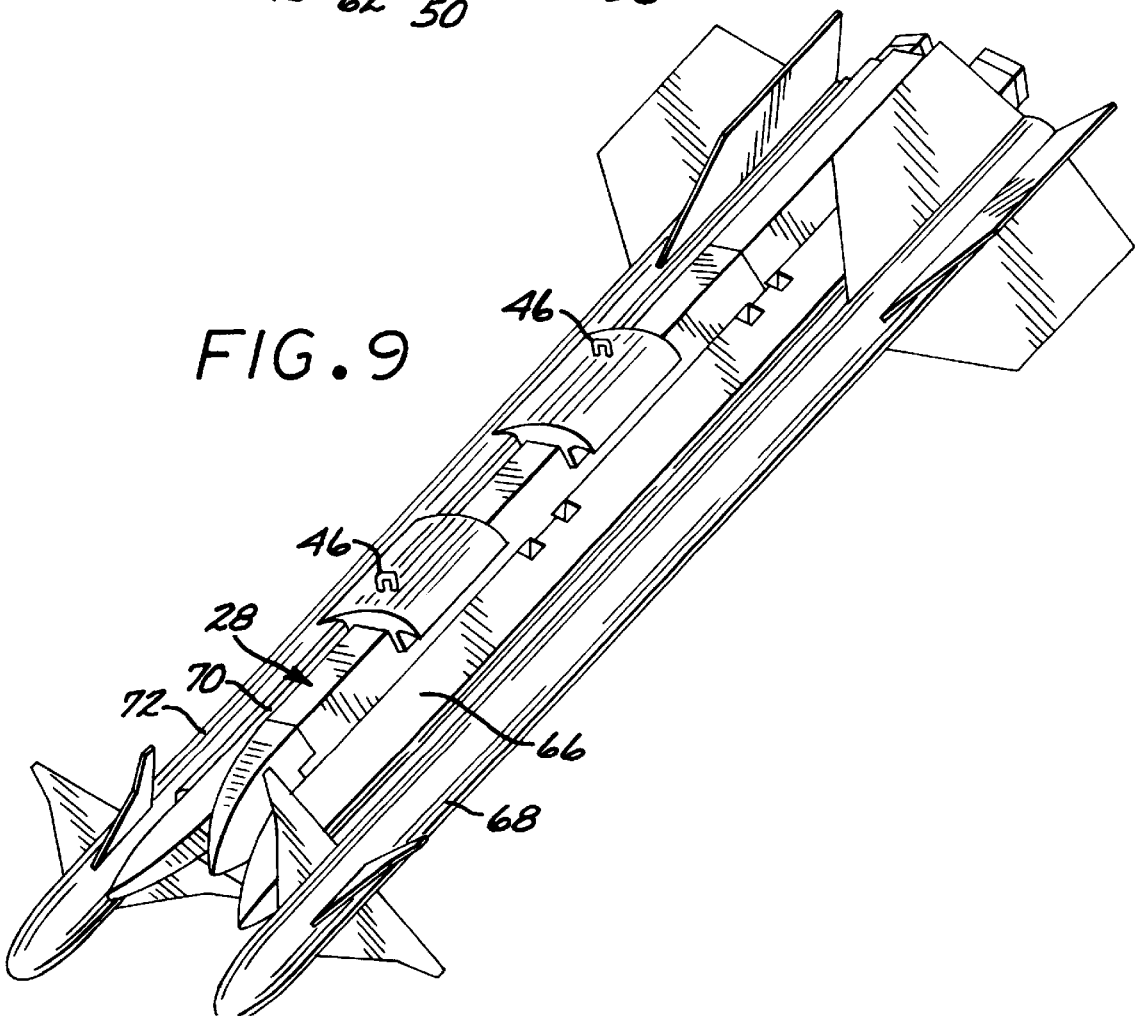
FIG. 9 is a perspective view of Sidewinder missiles carried on the third-missile launcher and the fourth-missile launcher.

The functionality of the missile launcher 28 may be further enhanced by providing a third-missile launcher 80 having a third-missile launch rail 66. The third-missile launcher 80 is non-permanently affixed to the first lateral side 38 of the launcher body 32, FIGS. 8–9. The third-missile launch rail 66 extends in the longitudinal direction 52. The third-missile launch rail 66 is dimensioned for a third missile 68. The illustrated third missile 68 is a Sidewinder missile, a known type of missile, and the third-missile launcher 80 is compatible with the dimensions of an LAU-7 or an LAU-12x launcher operable with the Sidewinder, AMRAAM, or ASRAAM missiles.

In the illustrated embodiment, there is additionally a fourth-missile launcher 82 having a fourth-missile launch rail 70. The fourth-missile launcher 82 non-permanently is affixed to the second lateral side 40 of the launcher body 32. The fourth-missile launcher rail 70 extends in the longitudinal direction 52. The fourth-missile launch rail 70 is dimensioned for a fourth missile 72 that may be the same as or different than the third missile 68. The illustrated fourth missile 72 is another Sidewinder missile, and the fourth-missile launcher 82 is compatible with the dimensions of an LAU-7 or LAU-12x launcher operable with the Sidewinder, AMRAAM, or ASRAAM missiles.

The use of the various missiles with the missile launcher 28 is limited by physical constraints. For example, the first missile 54 and the second missile 58 may not be used at the same time in this approach, but instead in the alternative. The third-missile 68 and the fourth missile 72 may not be used at the same time at the first missile 54 or the second missile 58, but the third missile 68 and the fourth missile 72 may be used at the same time as each other. (For other combinations of missile types, it may be possible to use two or more of the different types of missiles at the same time.) However, the present approach allows an aircraft to return from a mission in which one type of missile was used, and then to have the missile launcher reconfigured quickly and easily and have another type of missile loaded for another mission. Additionally, logistical support requirements for the aircraft are reduced.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A convertible multipurpose missile launcher, comprising:

a launcher body having a top side, a bottom side, a first lateral side, a second lateral side, a forward end, and an aft end;

a support attachment on the top side of the launcher body; and a launch rail structure on the launcher body, the launch rail structure including a first-missile launch rail on the bottom side of the launcher body and extending in a longitudinal direction, the longitudinal direction being defined as a direction extending between the forward end and the aft end of the launcher body, wherein the first-missile launch rail is dimensioned for a first missile, and a second-missile launch rail on the bottom side of the launcher body and extending in the longitudinal direction, wherein the second-missile launch rail is dimensioned for a second missile different from the first missile, and wherein the second-missile launch rail includes a stationary second-missile forward launch rail segment, and a movable second-missile aft launch rail segment, the movable second-missile aft launch rail segment being movable between a forward position and an aft position, and wherein the movable second-missile aft launch rail segment may be locked in the forward position when slid to the forward position and locked in the aft position when slid to the aft position.

2. The missile launcher of claim 1 wherein the movable second-missile aft launch rail segment is slidable on the launcher body.

3. The missile launcher of claim 1, wherein the movable second-missile aft launch rail segment is slidable on the first-missile launch rail.

4. The missile launcher of claim 1, wherein the first missile is a Maverick missile.

5. The missile launcher of claim 1, wherein the second missile is a HARM missile.

6. The missile launcher of claim 1, wherein the first missile is a Maverick missile and the second missile is a HARM missile.

7. The missile launcher of claim 1, further including a third-missile launcher affixed to the first lateral side of the launcher body and having a third-missile launch rail extending in the longitudinal direction, wherein the third-missile launch rail is dimensioned for a third missile.

8. The missile launcher of claim 7, wherein the third missile is a Sidewinder missile.

9. The missile launcher of claim 7, further including a fourth-missile launcher affixed to the second lateral side of the launcher body and having a fourth-missile launch rail extending in the longitudinal direction, wherein the fourth-missile launch rail is dimensioned for a fourth missile.

10. The missile launcher of claim 9, wherein the fourth missile is a Sidewinder missile.

11. A convertible multipurpose missile launcher, comprising:

a launcher body having a top side, a bottom side, a first lateral side, a second lateral side, a forward end, and an aft end;

a support attachment on the top side of the launcher body; and a launch rail structure on the launcher body, the launch rail structure including a first-missile launch rail on the bottom side of the launcher body and extending in a longitudinal direction, the longitudinal direction being defined as a direction extending between the forward end and the aft end of the launcher body, wherein the first-missile launch rail is dimensioned for a Maverick missile, and a second-missile launch rail on the bottom side of the launcher body and extending in the longitudinal direction, wherein the second-missile launch rail is dimensioned for a HARM missile, and wherein the second-missile launch rail includes a stationary second-missile forward launch rail segment, and a movable second-missile aft launch rail segment, the movable second-missile aft launch rail segment being slidable on the first-missile launch rail between a forward position and an aft position, and wherein the movable second-missile aft launch rail segment may be locked in the forward position when slid to the forward position and locked in the aft position when slid to the aft position.

12. The missile launcher of claim 11, further including a third-missile launcher affixed to the first lateral side of the launcher body and having a third-missile launch rail extending in the longitudinal direction, wherein the third-missile launch rail is dimensioned for a third missile.

13. The missile launcher of claim 12, wherein the third missile is a Sidewinder missile.

14. The missile launcher of claim 12, further including a fourth-missile launcher affixed to the second lateral side of the launcher body and having a fourth-missile launch rail extending in the longitudinal direction, wherein the fourth-missile launch rail is dimensioned for a fourth missile.

15. The missile launcher of claim 14, wherein the fourth missile is a Sidewinder missile.

16. A convertible multipurpose missile launcher interconvertible between carrying a first missile and a second missile, the missile launcher comprising:

a launcher body having a top side, a bottom side, a first lateral side, a second lateral side, a forward end, and an aft end;

a support attachment on the top side of the launcher body; and a launch rail structure on the launcher body, the launch rail structure including a first-missile launch rail on the bottom side of the launcher body and extending in a longitudinal direction, the longitudinal direction being defined as a direction extending between the forward end and the aft end of the launcher body, wherein the first-missile launch rail is dimensioned for a first missile, and a second-missile launch rail on the bottom side of the launcher body and extending in the longitudinal direction, wherein the second-missile launch rail is dimensioned for a second missile different from the first missile, and wherein the second-missile launch rail includes a second-missile first launch rail segment, and a second-missile second launch rail segment, the second-missile second launch rail segment being movable between a first position and a second position, wherein the first missile may be carried on the first-missile launch rail when the second-missile launch rail segment is in the first position, and the second missile may be carried on the second-missile launch rail when the second-missile second launch rail segment is in the second position.

17. The missile launcher of claim 16, wherein the second-missile second launch rail segment is slidable on the launcher body.

18. The missile launcher of claim 16, further including a third-missile launcher affixed to the first lateral side of the launcher body and having a third-missile launch rail extending in the longitudinal direction, wherein the third-missile launch rail is dimensioned for a third missile.

19. The missile launcher of claim 18, further including a fourth-missile launcher affixed to the second lateral side of the launcher body and having a fourth-missile launch rail extending in the longitudinal direction, wherein the fourth-missile launch rail is dimensioned for a fourth missile.

20. The missile launcher of claim 16, wherein the second-missile first launch rail segment is stationary.

* * * * *